US005500652A

United States Patent [19]

Huber et al.

[11] Patent Number: 5,500,652

[45] Date of Patent: Mar. 19, 1996

[54] DISPLAY ELEMENT WITH REFLECTIVE LENS

[75] Inventors: Terrence D. Huber; Mark E. Huber, both of Spokane, Wash.

[73] Assignee: American Electronic Sign Company, Spokane, Wash.

[21] Appl. No.: 331,261

[22] Filed: Oct. 28, 1994

Related U.S. Application Data

[63] Continuation of Ser. No. 188,602, Jan. 27, 1994, abandoned, which is a continuation of Ser. No. 978,987, Nov. 19, 1992, abandoned.

[51] Int. Cl.[6] ..... G09G 3/34

[52] U.S. Cl. ..... 345/84; 340/815.76

[58] Field of Search ..... 40/582, 583; 362/337, 362/336, 338, 339, 340; 340/815.04, 815.05, 815.55, 815.62, 815.76, 815.73; 345/84, 85, 86, 76, 77, 82, 44, 48, 111

[56] References Cited

U.S. PATENT DOCUMENTS

| | | | |
|---|---|---|---|
| 755,272 | 3/1904 | Burnham . | |
| 1,191,023 | 7/1916 | Naylor . | |
| 1,393,665 | 10/1921 | Closson . | |
| 2,798,147 | 5/1952 | Orsatti | 362/337 |
| 3,140,553 | 7/1964 | Taylor | 40/28 |
| 3,210,757 | 10/1965 | Jacob . | |
| 3,295,238 | 1/1967 | Winrow | 40/28 |
| 3,518,664 | 6/1970 | Taylor . | |
| 3,562,938 | 2/1971 | Salam | 40/28 |
| 3,745,563 | 7/1973 | Jones et al. . | |
| 3,775,881 | 12/1973 | Salam | 40/2 C |
| 3,916,403 | 10/1975 | Mandzsu et al. . | |
| 3,975,728 | 8/1976 | Winrow . | |
| 3,995,386 | 12/1976 | Salam | 40/28 C |
| 4,015,255 | 3/1977 | Wood . | |
| 4,040,193 | 8/1977 | Matsuda et al. | 40/28 C |
| 4,070,668 | 1/1978 | Kawaharada et al. . | |
| 4,163,332 | 8/1979 | Salam | 40/449 |
| 4,215,338 | 7/1980 | Selig . | |
| 4,327,357 | 4/1983 | Skrobisch . | |
| 4,410,888 | 10/1983 | Selig . | |
| 5,043,856 | 8/1991 | Levin | 362/338 |
| 5,111,193 | 5/1992 | Huber et al. | 345/111 |
| 5,148,156 | 9/1992 | Huber et al. | 345/84 |
| 5,266,935 | 11/1993 | Wahlert | 345/84 |

FOREIGN PATENT DOCUMENTS

| | | |
|---|---|---|
| 641350 | 5/1962 | Canada . |
| 2306067 | 9/1973 | Germany . |
| 355440 | 8/1931 | United Kingdom . |
| 934001 | 8/1963 | United Kingdom . |

*Primary Examiner*—Curtis Kuntz
*Assistant Examiner*—Vivian W. Chang
*Attorney, Agent, or Firm*—Wells, St. John, Roberts, Gregory & Matkin

[57] ABSTRACT

An electronic display element for use in an information display device has a reflective lens with a substantially smooth front surface and a non-smooth back surface. The back surface has multiple uniformly shaped polyhedron cells with hexagonal-shaped bases and square faces. The polyhedron cells are arranged in alternating first and second horizontal rows which are evenly offset from one another. The back surface of the lens presents a cube prism pattern which effectively transmits light originating from behind the lens without significant interference, and optimally reflects light originating from in front of the lens 30 to thereby improve both backlegibility and reflectivity.

1 Claim, 5 Drawing Sheets

DISPLAY ELEMENT WITH REFLECTIVE LENS

This is a continuation of abandoned U.S. application Ser. No. 08/188,602, filed Jan. 27, 1994, which in turn was a continuation of abandoned U.S. application Ser. No. 07/978,987, filed Nov. 19, 1992.

TECHNICAL FIELD

This invention relates to electronic display elements for informational display devices, and more particularly, to lenses employed in the display elements.

BACKGROUND OF THE INVENTION

Electronic display devices are commonly used today in many applications, including portable highway safety signs, billboards, scoreboards, and other informational displays. These display devices consist of multiple rows and columns of individual display elements which constitute controllable pixels in a visual display. Certain patterns of the display elements can be programmed to create any desired message or design.

Electronic display elements for use in electronic display devices are known in the art. One such display element includes an opaque panel having an aperture provided therein and an associated flap which is pivotable from a first position covering the aperture to a second position uncovering the aperture. The side of the flap which faces an observer when the aperture is covered has a non-reflective surface. The other side of the flap which faces the observer when the flap is uncovered has a highly reflective surface. Accordingly, when the flap is opened, light is emitted through the aperture and reflected from the reflective surface of the flap towards the observer.

U.S. Pat. No. 5,111,193 to Huber et al. describes an electronic display element having a translucent lens in a panel aperture and a pivotable flap which covers and exposes the lens.

The present invention provides a translucent lens which effectively transmits light originating from behind it without significant interference, and reflects light originating from in front of it.

BRIEF DESCRIPTION OF THE DRAWINGS

One or more preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

U.S. Pat. No. 5,111,193 to Huber et al. is hereby incorporated by reference into this disclosure.

Figure 1:
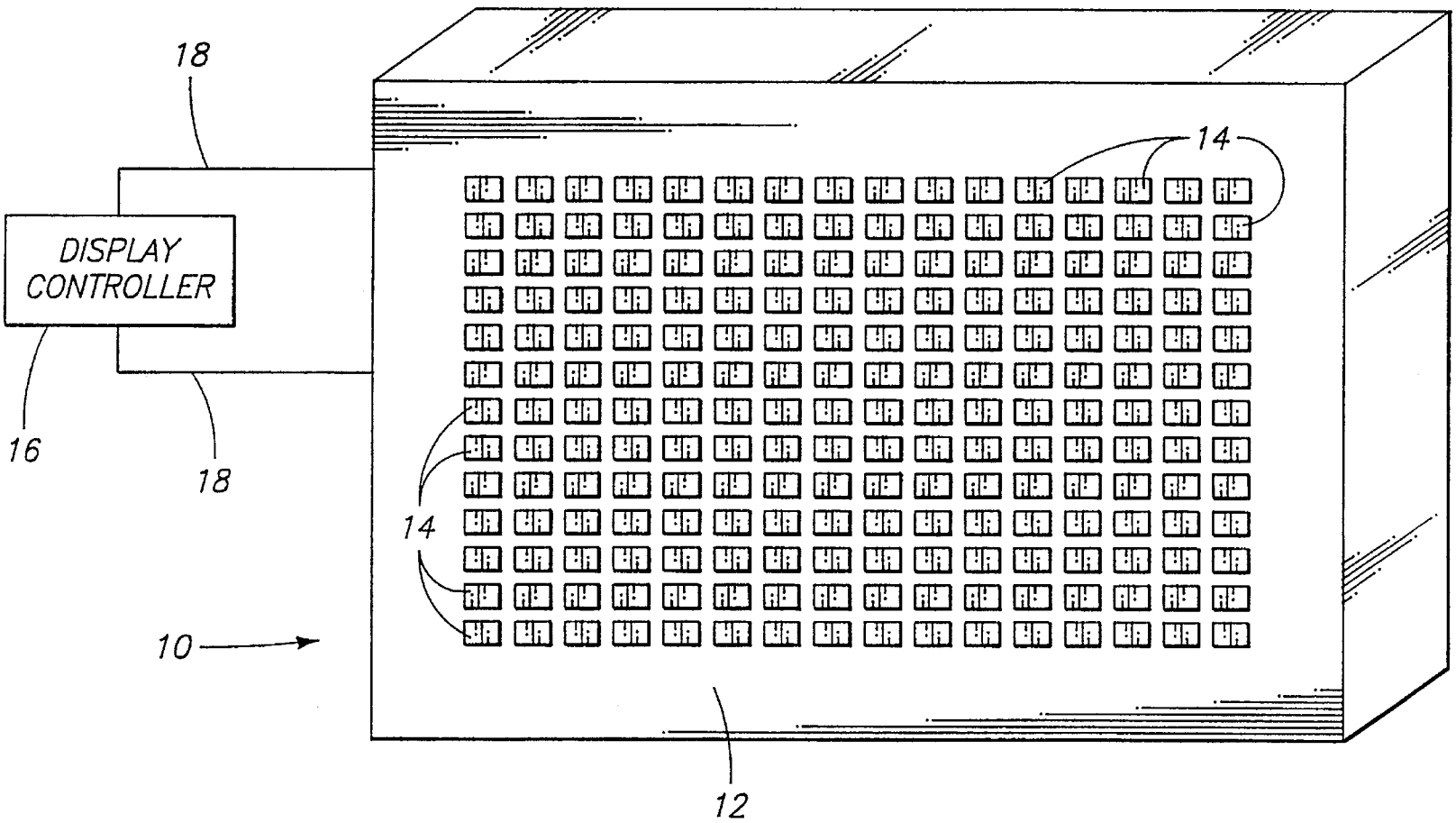
FIG. 1 is a diagrammatic illustration of an informational display device.

FIG. 1 shows an electronic display device 10 constructed in accordance with this invention. Device 10 has a front opaque substrate or panel 12 with multiple apertures arranged at selected spaced distances in a matrix pattern of rows and columns. Panel 12 is preferably a laminated material suitable for forming a printed circuit board (PCB), but alternatively could be formed of any material including metal, wood, or plastic.

Device 10 also has multiple display elements 14 for each corresponding aperture in panel 12. Individual display elements 14 have an opaque flap (discussed below) which selectively covers or exposes the aperture in panel 12. Each flap has a reflective surface on the side which faces an observer when the aperture is exposed and a non-reflective surface on the opposing side which faces the observer when the aperture is covered. When the display element is "on" (i.e., when the flap exposes the aperture), light from within device 10 emits through the aperture and light originating exterior to device 10 is reflected from the reflective flap surface towards an observer. When the display element is "off" (i.e., when the flap covers the aperture), light is prevented from passing through the aperture, and no light is reflected from the non-reflective flap surface. In this manner, each individual display element constitutes a controllable pixel which can be turned "on" and "off" to create the desired visual effect on the display device. Lights or other illuminating means (not shown) can be mounted interior to display device 10 to transmit light through the apertures of the display elements which are turned "on". Such illuminating means can also be mounted exterior to display device 10 and directed back toward the display panel 12 to enlighten the reflective surfaces of the flaps on those electronic display elements which are turned "on".

Display device 10 also has a display controller 16 which actuates individual display elements or pixels to create the desired visual image. The display controller is capable of receiving data indicative of a message or design, and transforming that data into pixel data to selectively turn "on" or "off" specific display elements 14 to effectuate the desired visual image. Display controller 16 is coupled to a bussing system (illustrated graphically by lines 18) which links the display controller 16 to each individual display element 14 of display device 10. Display controller 16 is preferably a microprocessor, but can be any other suitable means for selectively actuating the display elements, such as an Application Specific Integrated Circuit (ASIC) or a microcontroller. Display controller 16 may also include amplifiers, drivers, and the like to insure that a sufficient electrical current is sent to the display elements.

Bussing system 18 includes conductive lines (not shown) which are electrically coupled to each and every display element 14. These conductive elements supply electric current to the electromagnets (discussed below) of the display elements. These conductors can be in the form of (1) wires which are individually soldered to contact leads on the electromagnets, or (2) conductive traces which are deposited and patterned on the back side of panel 12 in a manner similar to applying metallization strips on a PCB, or (3) any other means for supplying electric current to individual electromagnets at the display elements.

Figure 2:
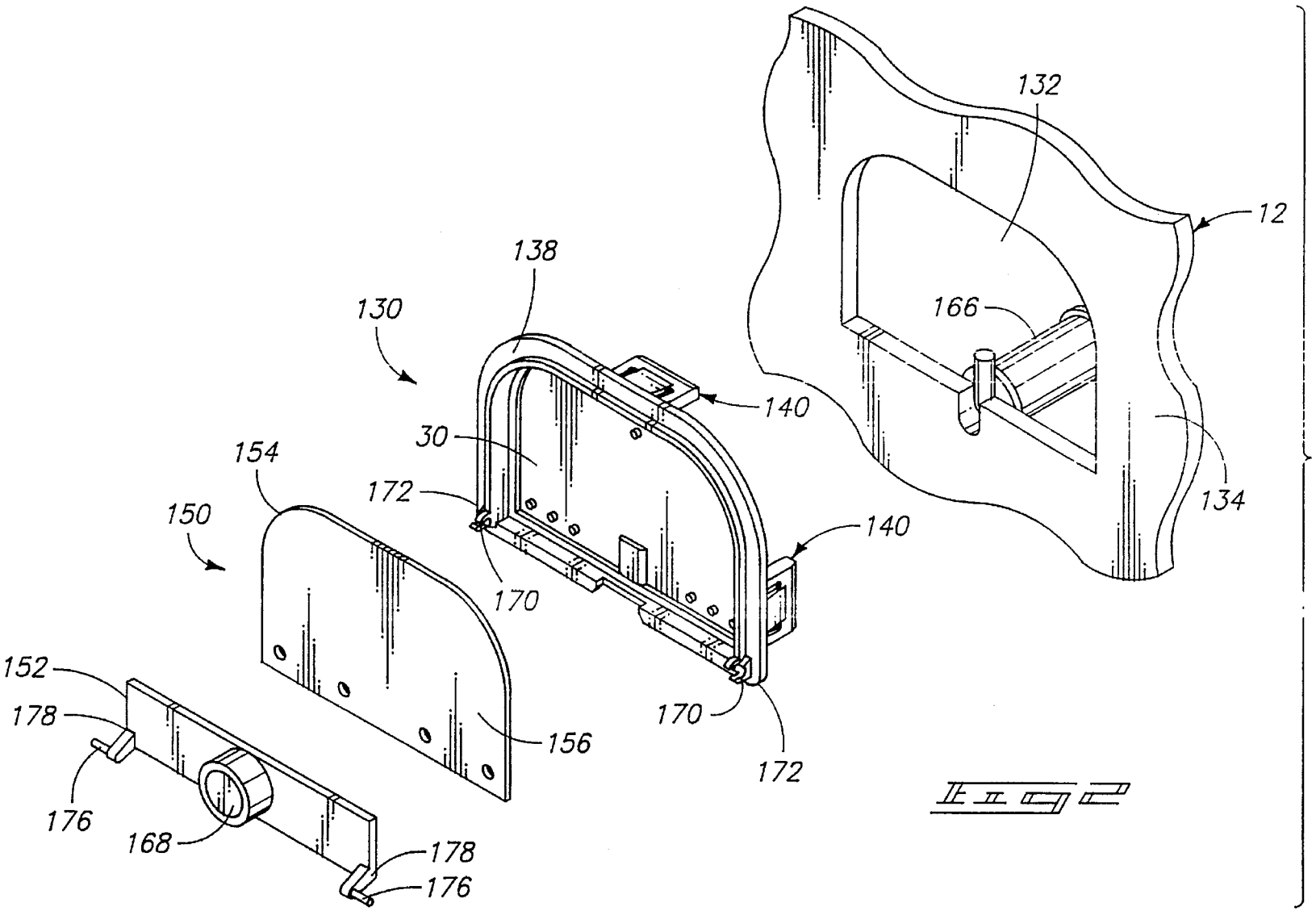
FIG. 2 is an exploded, perspective view of an individual display element.

FIG. 2 shows an electronic display element 130 for use in information display device 10. Display element 130 is mounted to panel 12 for its associated aperture 132. Panel 12 has a front or first side 134 and a back or second side.

Display element 130 has a translucent lens 30 which has a periphery that is sized and shaped to fit within aperture 132 of panel 12. Lens 30 is positioned within a peripheral frame 138 which extends about lens 30. Frame 138 has three fastening clips 140 (the third is not shown in FIG. 2) which releasibly fasten frame 138 to panel 12.

Display element 130 includes a flap 150 which is pivotally mounted onto frame 138 to selectively cover or expose lens 30. Flap 150 comprises a support 152 and an opaque member 154. Opaque member 154 has a periphery that is complementary in size and shape to that of lens 30. Flap member 154 has a non-reflective surface 156 on the side which faces the observer when the flap covers lens 30, and a reflective surface on the opposite side thereof which faces the observer when the flap exposes lens 30.

Display element 130 has a magnet 168 which is fixed to support 152 of flap 150 and an electromagnet 166 which is secured to the back side of panel 12 adjacent to aperture 132. Electromagnet 166 selectively interacts with magnet 168 to cause the flap 150 to cover or expose lens 30. The construction of electromagnet 166 and the operation of flap 150 caused by the interaction between electromagnet 166 and magnet 168 are described in detail in U.S. Pat. No. 5,111,193 to Huber et al., which is incorporated herein by reference.

Frame 138 has a pair of axle bearings 170 positioned at opposing lower corners 172 thereof. Flap 150 has a pair of axle pins 176 positioned at opposing lower corners 178 of support 152. Axle bearings 170 and axle pins 176 are aligned along a pivot axis. In this manner, flap 150 has rotational movement about the pivot axis to selectively cover or expose lens 30. Pins 176 and bearings 170 thereby constitute a preferred embodiment of complementary bearing means for facilitating movement of flap 150. Additionally, the axle pins and bearings could be reversed such that the pins are mounted on frame 138 and the bearings are mounted on flap support 152.

Figure 3:
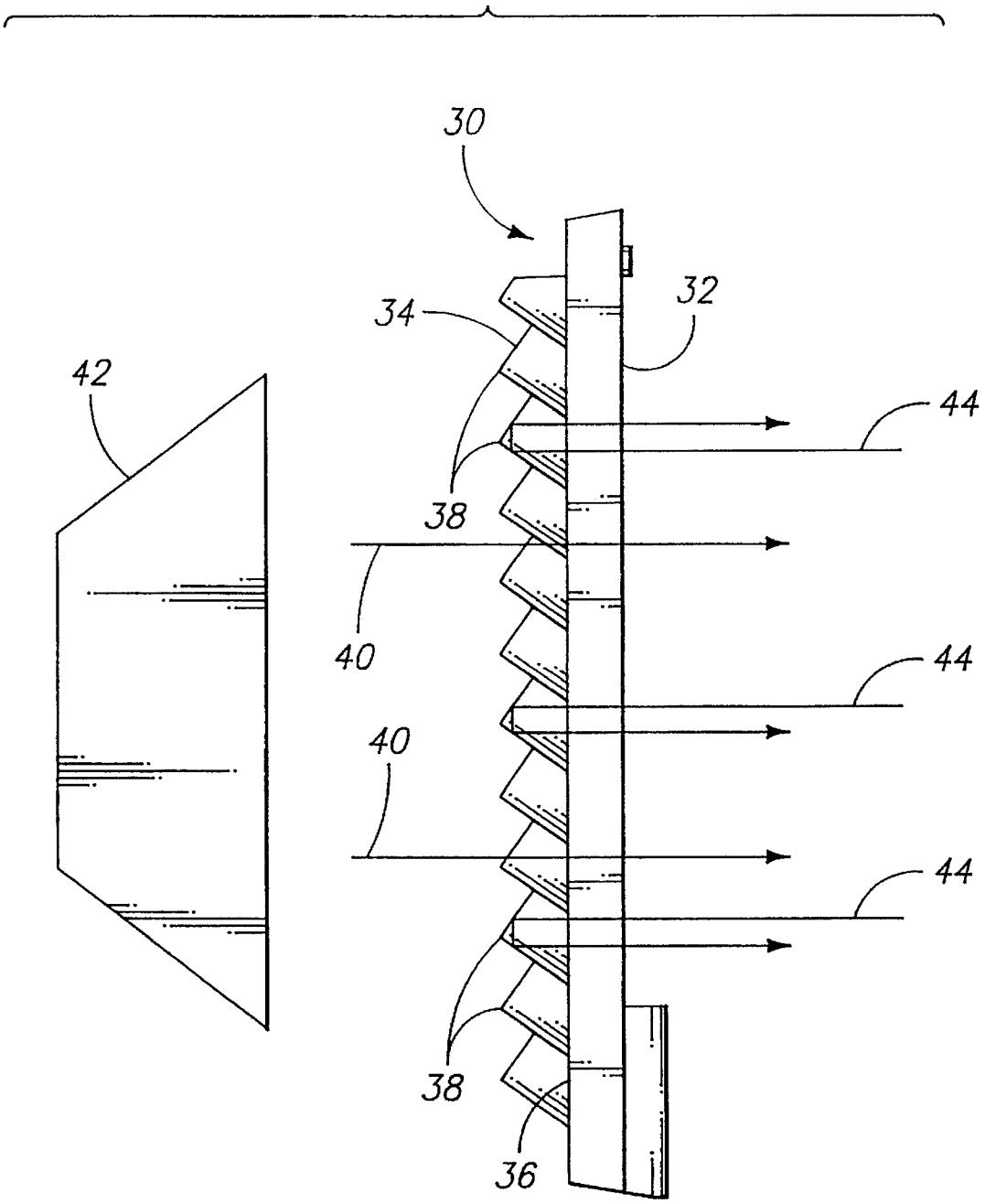
FIG. 3 is a diagrammatic illustration of a reflective lens according to this invention, and its ability to transmit and reflect light.

FIGS. 3–7 show lens 30 in more detail. A diagrammatic side view of lens 30 positioned in front of a light source 42 is shown in FIG. 3. Lens 30 is formed of colored plastic, which is preferably red or orange. Lens 30 has a first or front surface 32 and a second or back surface 34 which are separated by a planar boundary 36. Front surface 32 is substantially smooth and flat. In contrast, back surface 34 has a cube prism pattern which involves multiple, uniformly shaped individual cubes oriented in a manner such that one corner 38 of each cube projects outwardly away from front surface 32 or planar boundary 36. This cube prism pattern is discussed in more detail below with reference to FIGS. 4–7.

The lens of this invention has advantages over prior art lenses in that it enhances reflectivity and adds to backlegibility. The combined flat front surface and the cubed pattern back surface allows light (represented by arrows 40) from light source 42 to transmit efficiently through lens 30 without significant internal reflection or diffraction. Lens 30 therefor transmits light originating from the back side of lens 30 more efficiently, which increases backlegibility.

Light which approaches lens 30 from the front side (represented by arrows 44) is efficiently reflected by the cube prism pattern provided on the back surface 34 of lens 30. This cube prism pattern thereby enhances reflectivity. In total, it has been determined that lens 30 of this invention increases brightness by a factor of 10.

Figure 4:
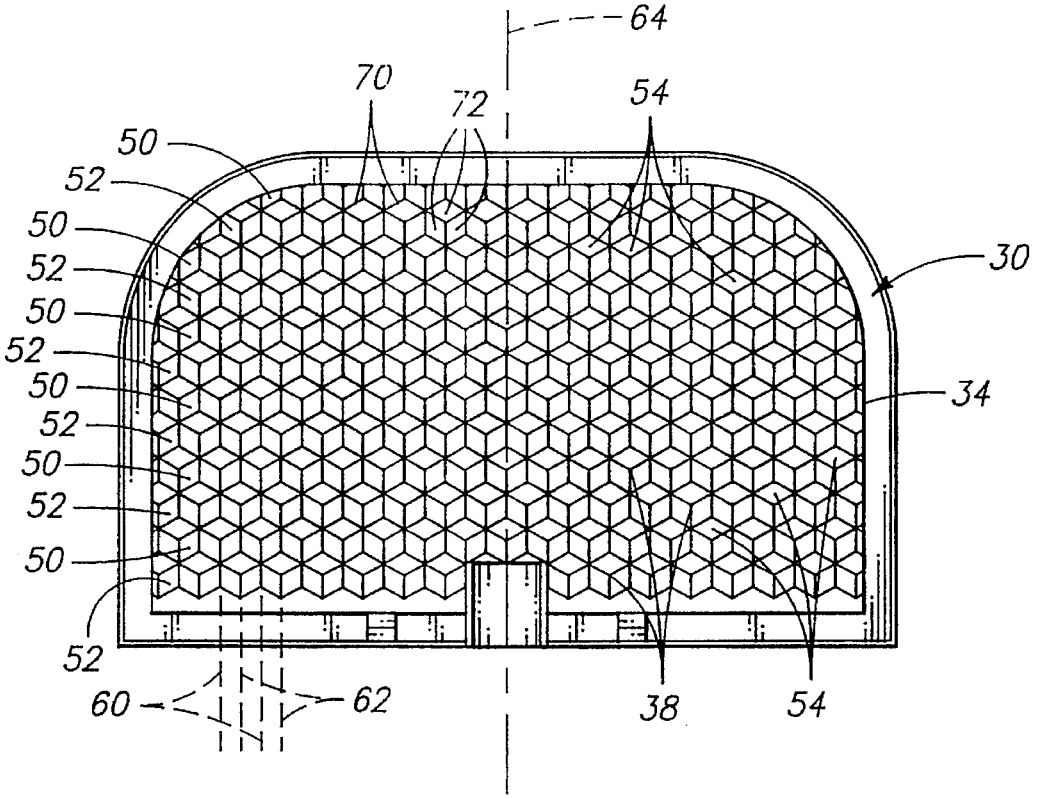
FIG. 4 is a back plan view of the reflective lens of this invention.
Figure 5:
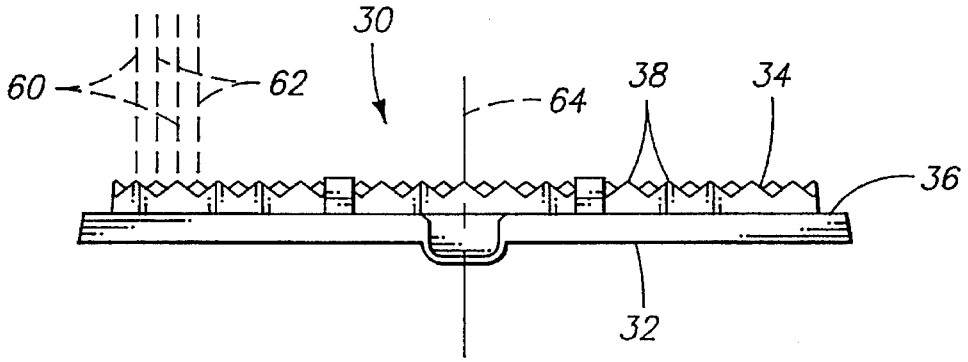
FIG. 5 is a bottom view of the FIG. 4 lens.

In FIG. 4, the cube prism pattern of back surface 34 has multiple alternating first horizontal rows 50 and second horizontal rows 52. All of the rows have multiple uniformly shaped cubes 54. Only three faces of cubes 54 are exposed. Cubes 54 are oriented in such a manner that one corner (represented with numeral 38) of each cube projects outwardly from the planar boundary 36 (FIGS. 5 and 6).

First rows 50 and second rows 52 are slightly offset or staggered from one another. Cubes 54 in first rows 50 are aligned relative to their corners 38 along first vertical axes 60. Similarly, the cubes in second rows 52 are aligned relative to their corners 38 along second vertical axes 62. First rows 50 are also centered on a central axis 64 (which coincides with one of the first vertical axes 60), while second rows 52 are slightly offset and not centered on central axis 64. The cubes are arranged symmetrically such that second vertical axes 62 are parallel to, offset from, and centered between adjacent first vertical axes 60.

As an alternative way to describe the cube prism pattern, back surface 34 of lens 30 has multiple uniformly shaped polyhedron cells 70 which have hexagonal-shaped bases (when viewed from the back as shown in FIG. 3) and parallelogram faces 72. Preferably, the polyhedron cells 70 have three parallelogram faces, which are most preferably square.

Figure 7:
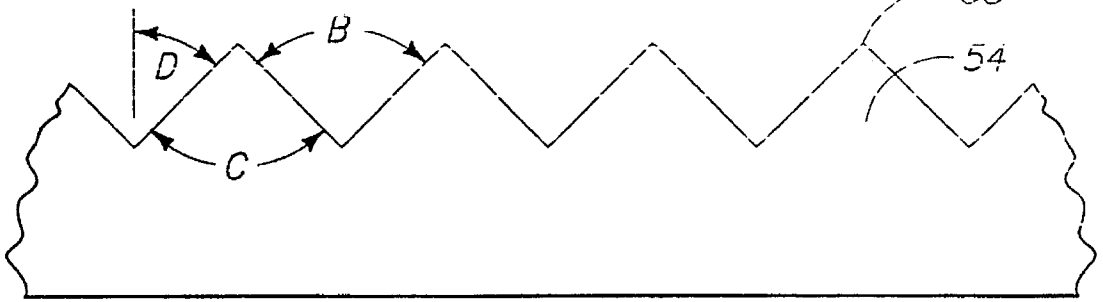
FIG. 7 is a sectional view taken through lines 7—7 in FIG. 6.
Figure 6:
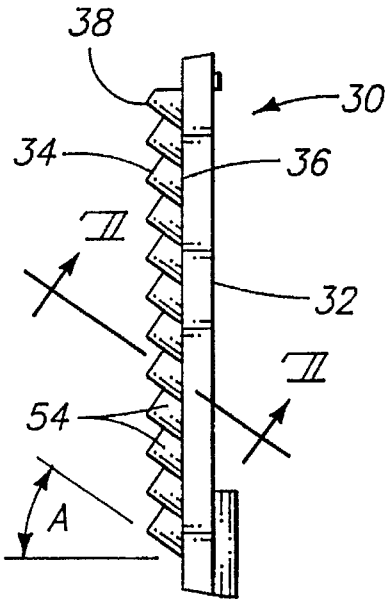
FIG. 6 is a end view of the FIG. 4 lens.

FIGS. 6 and 7 illustrate the orientation of cubes 54 in more detail. As shown in FIG. 6, cubes 54 are tilted or angled at angle A to provide the appropriate orientation to project corners 38 away from planar boundary 36. Preferably, angle A is approximately 35°. In FIG. 7 (which is taken through lines 7—7 in FIG. 6 and parallel to the face of the cube rows), the internal dimensions of each cube 54 are identical and symmetrical. Angle B between adjacent faces of adjacent cubes 54 is preferably 90°. Likewise, angle C between adjacent faces of the same cube 54 is preferably 90°. Cubes 54 are oriented in such a manner that angle D is preferably 45°.

This perfectly symmetrical, cube pattern on back surface 34 permits light which originates from behind lens 30 to pass through without significant interference, while optimally reflecting light which originates in front of lens 30. Accordingly, the lens of this invention is significantly brighter than conventional lenses.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A pixel for use in a visual matrix display comprising:

a frame having a front and a rear surface and defining an aperture;

a flap pivotally borne by the front surface of the frame and moveable along a given path of travel between a first position, wherein the flap covers the aperture and renders the pixel nonoperational, to a second position which renders the pixel operational, and wherein the flap has at least one retroreflective surface which is positioned in a light reflecting orientation when the flap is located in the second position, and wherein the retroreflective surface is about one-half of the surface area of the operational pixel;

means borne by the frame for selectively moving the flap along the given path of travel;

a light source positioned rearwardly of the frame and operable to emit light in the direction of the aperture;

means for selectively energizing the light source when the flap is in the second position; and a substantially planar, retroreflective lens borne by the frame and positioned in occluding relation relative to the aperture, the retroreflective lens having a uniformly translucent main body with a front surface which is substantially planar, and a rear surface which has a plurality of uniformly spaced polyhedron cells having hexagonal bases, and parallelogram faces, the retroflective lens being about one-half of the surface area of the operational pixel, and which forms in combination with the retroreflective surface of the flap, an operational pixel which is substantially uniformly retroreflective, the retroreflective lens retroreflecting light striking the retroreflective lens and which originates from locations in front of the retroreflective lens, the operational pixel, under conditions of darkness, and in a deenergized state, reflecting artificial light striking the retroreflective surface of the flap, and the front surface of the retroreflective lens such that the pixel remains visibly discernible notwithstanding the deenergized state of the light source.

* * * * *